United States Patent [19]

Maeda et al.

[11] Patent Number: 4,847,167

[45] Date of Patent: Jul. 11, 1989

[54] FIBER-REINFORCED METALLIC COMPOSITE MATERIAL

[75] Inventors: Hideo Maeda, Shin-Minato; Ken-ichi Nishio, Funabashi, both of Japan

[73] Assignee: Sumitomo Chemical Company, Limited, Osaka, Japan

[21] Appl. No.: 218,979

[22] Filed: Jul. 14, 1988

[30] Foreign Application Priority Data

Jul. 15, 1987 [JP] Japan ..... 62-177982
Apr. 25, 1988 [JP] Japan ..... 63-103664

[51] Int. Cl.[4] ..... B22D 15/04; B22D 19/14
[52] U.S. Cl. ..... 428/614
[58] Field of Search ..... 428/614

[56] References Cited

U.S. PATENT DOCUMENTS

| | | | |
|---|---|---|---|
| 3,860,443 | 1/1975 | Lachman et al. | 428/614 |
| 4,444,603 | 4/1984 | Yomatsuta et al. | 428/614 |
| 4,452,865 | 6/1984 | Yamatsuta et al. | 428/614 |
| 4,465,741 | 8/1984 | Yamatsuta et al. | 428/614 |
| 4,489,138 | 12/1984 | Yamatsuta et al. | 428/614 |
| 4,526,841 | 7/1985 | Yamatsuta et al. | 428/614 |
| 4,547,435 | 10/1985 | Yamatsuta et al. | 428/614 |

FOREIGN PATENT DOCUMENTS

| | | |
|---|---|---|
| 0062496 | 3/1982 | European Pat. Off. . |
| 2297255 | 1/1975 | France . |
| 2080865 | 2/1982 | United Kingdom . |
| 2081353 | 2/1982 | United Kingdom . |

*Primary Examiner*—L. Dewayne Rutledge
*Assistant Examiner*—David W. Schumaker
*Attorney, Agent, or Firm*—Birch, Stewart, Kolasch & Birch

[57] ABSTRACT

Improved fiber-reinforced metallic composite material comprises as a matrix a metal alloy having a lower melting point than magnesium and being chemically inactive (e.g. zinc, cadmium, indium, tin, thallium, lead, bismuth and polonium) or and as a reinforcement inorganic fibers of 15 to 70% by volume, in which the metal alloy composing the matrix contains 0.01 to 10% by weight of one or more metals of group IA or group IIA (except beryllium) in the periodic table (e.g. lithium, sodium, potassium, rubidium, cesium, francium, magnesium, calcium, strontium, barium and radium). The composite material has improved mechanical strength, and is useful as a material for various parts and apparatuses in various industrial fields such as aerospace, atomic power and automobile industries.

5 Claims, No Drawings

FIBER-REINFORCED METALLIC COMPOSITE MATERIAL

This invention relates to a fiber-reinforced metallic composite material, and more particularly to a fiber-reinforced metallic composite material comprising a matrix consisting of n alloy produced by incorporating one or more metals of group IA or group IIA (except beryllium) in the periodic table into a metal or alloy having a comparatively lower melting point and being chemically inactive and inorganic fibers as a reinforcement, which has excellent mechanical strength (the fiber-reinforced metallic composite material being, hereinafter, referred to merely as "composite material").

PRIOR ART

There have recently been developed and utilized in various industial fields some composite materials comprising an inorganic fiber (e.g. alumina fiber, silica fiber, silicon carbide fiber, boron fiber, etc.) and a matrix consisting of a metal selected from aluminum, magnesium, copper, nickel, titanium, etc. or an alloy thereof.

The metals or metal alloys as mentioned above have a high melting point and are chemically active, and hence, when these metals or metal alloys are reinforced with the inorganic fiber, a reaction proceeds at the interface of them, which causes deterioration of fibers, and hence, there cannot be obtained a composite material having excellent mechanical strength. It has been proposed to prevent such deterioration of fibers by various means, for example, by treating the surface of the fibers with a coating agent, or by adding thereto a metal or alloy which is effective for preventing the deterioration of fibers.

When aluminum, magnesium, or titanium is used as a matrix metal, there can be provided a light weight composite material having a high strength and high modulus. In addition, when copper, nickel, or titanium is used as a matrix metal, there can be provided a composite material having high strength and a high modulus at a high temperature.

On the other hand, metals having a comparatively lower melting point and being chemically inactive (e.g. tin, zinc, etc.) have a comparatively larger specific weight but have comparatively lower strength, and hence, when these metals are used as a matrix metal, they are intolerable to the weight of themselves, and it must be made in a thick product or in a structure having a support, which gives large design limitation. Likewise, metals having a comparatively lower melting point and being chemically inactive (e.g. zinc, cadmium, indium, thallium, bismuth, polonium, etc.) have less strength, and hence, these give design limitations like zinc and lead.

Under the circumstances, it has been desired to improve the strength of a matrix composed of the metal or alloy having a comparatively lower melting point and being chemically inactive (e.g. zinc, cadmium, indium, tin, thallium, lead, bismuth, polonium, etc. or alloys thereof) by making a composite material with inorganic fibers. Although these metals used as a matrix are easily handled in view of the lower melting point, they do not react with inorganic fibers because they are chemically inactive. Accordingly, the interfacial bond between the matrix and inorganic fibers is extremely weak and the external stress cannot be transferred to fibers via matrix, which causes first the break of fibers and then pull-out of fibers, and thereby the desired composite material having excellent mechanical strength cannot be obtained.

SUMMARY DESCRIPTION OF THE INVENTION

In view of the above-mentioned situation, the present inventors have intensively studied as to the improvement of the strength of matrix material composed of an inactive matrix and inorganic fibers and have found that in order to obtain maximum strength of the inorganic fibers, it is to be forced to occur shearing stress at interface between the fibers and matrix and forced to progress break along with the interface, and that for this purpose, it is effective to use as a matrix an alloy produced by incorporating one or more metals of group IA or group IIA (except beryllium) in pedioric table to a metal having a lower melting point and being inactive as a matrix (hereinafter referred to as "matrix metal"), and thereby there can be obtained the desired composite material having excellent mechanical strength.

An object of this invention is to provide a fiber-reinforced metallic composite material wherein a metal or alloy having a lower melting point and being chemically inactive is used as a matrix metal and the mechanical strength thereof is improved. Another object of the invention is to provide a fiber-reinforced metallic composite material using as a matrix an alloy of the matrix metal incorporated with one or more metals of group IA or group IIA (except beryllium) in the periodic table. These and other objects and advantages of the invention will be apparent to those skilled in the art from the following description.

DETAILED DESCRIPTION OF THE INVENTION

The composite material of this invention comprises as a matrix a metal or alloy having a lower melting point and being chemically inactive and as a reinforcement inorganic fibers of 15 to 70% by volume, which is characteristic in that the alloy composing the matrix contains 0.01 to 10% by weight of one or more metals of group IA or group IIA (except beryllium) in the periodic table in addition to the matrix metal having a lower melting point and being chemically inactive.

The inorganic fibers used in this invention include carbon fiber, silica fiber, silicon carbide fiber, boron fiber, alumina fiber, and the like. The inorganic fibers are contained in the composite material of this invention in an amount of 15 to 70% by volume based on the whole volume of the composite material. When the amount of the fibers is less than 15% by volume, the desired reinforcing effect cannot sufficiently be achieved, and on the other hand, when the amount is over 70% by volume, the strength of the composite material is rather lowered due to the mutual contact of fibers. The fibers may have any form, such as long fibers or short fibers, and any form of fibers can be used depending on the desired utilities of the product. These forms of fibers may be used alone or in combination thereof. The fibers are applied to in various orientations, such as unidirectional crossplying, random orientation, and the like in order to give the desired mechanical strength and elasticity. Among these inorganic fibers, the most preferable fiber for achieving the desired reinforcing effect is alumina fiber as disclosed in Japanese Patent Second Publication (Kokoku) No. 13768/1976, i.e. the alumina fiber having an alumina ($Al_2O_3$) content of 72 to 100% by weight, preferable 75 to 98% by weight, and a silica ($SiO_2$) content of 0 to 28% by weight, preferably 2 to 25% by weight, and exhibiting substantially no reflection by X-ray diffraction due to the $\alpha$-$Al_2O_3$ structure. This alumina fiber may optionally be incorporated with a refractory compound, for example, one or more oxide compounds of metals selected from lithium, beryllium, boron, sodium, magnesium, silicon, phosphorus, potassium, calcium, titanium, chromium, manganese, yttrium, zirconium, lanthanum, tungsten, barium, and the like, unless they do not affect the desired properties.

The matrix metals used in this invention include metals having a comparatively lower melting point and being chemically inactive, for example, zinc, cadmium, indium, tin, thallium, lead, bismuth, and polonium (provided that these alloys do not contain metals of group IA and group IIA (except beryllium) in periodic table). The metals having a comparatively lower melting point mean metals having a melting point of 150° to 500° C. The most suitable matrix metal may be elected in accordance with the conditions and circumstances where the products are used. For instance, for the purpose of using as a battery or for protection of irradiation from X-ray or $\gamma$-ray, lead is preferable. As an anode material for protection of electric corrosion, zinc is used. These metals used in this invention may optionally contain a small amount of impurities unless they do not produce undesirable effects on the use of the product.

This invention is characteristic in the use of a matrix of the above metals which is incorporated by 0.01 to 10% by weight of one or more metals selected from the metals of group IA and group IIA (except beryllium) in the periodic table, by which the weak bond between the matrix and fibers is improved to give a composite material having a strength close to the theoretical strength.

The metals of group IA and group IIA (except beryllium) in the periodic table include lithium, sodium, potassium, rubidium, cesium, francium, magnesium, calcium, strontium, barium and radium.

The mechanism of improvement of strength due to the matrix metals incorporated with the above-mentioned specific metals may be assumed as follows.

The metals having a comparatively lower melting point and being chemically inactive, for example, zinc, cadmium, indium, tin, thallium, lead, bismuth and polonium are inert to inorganic fibers, and hence, no reaction proceeds at the interface of them. However, when one or more metals of group IA or group IIA (except beryllium) in the periodic table are added to the matrix metals, these additional metals are contained in a concentration of higher than the average at the surface of the matrix metals, and thereby the additional metals are present at a high concentration at the interface of fibers-matrix and induce the interfacial reaction without deterioration of the fibers and hence the bonding strength at the interface reaches the most suitable state.

When a composite material produced by using the matrix of an alloy containing the additional metals is observed by a scanning electron microscope at a rupture cross-section thereof, the composite material has a stronger bonding at the fiber/matrix interface than the composition material obtained from a matrix of an alloy to which no additional metal is incorporated. It is also observed that pull-out of fibers is largely decreased and the bonding force at the interface of fibers-matrix is increased.

The most suitable amount of the additional metals may vary depending on the kinds of the inorganic fibers and/or the kinds of the matrix metals, but the amount is usually in the range of 0.01 to 10% by weight, preferably 0.1 to 5% by weight, based on the weight of the matrix metals. When the addition amount is less than 0.01% by weight, the desired improvement in the properties of the composite material cannot sufficiently be achieved, but on the other hand, when the amount is over 10% by weight, the matrix metals lose the original excellent properties, that is, show lowering of corrosion resistance and lowering of tensile elongation, and further, the reaction of the fiber/matrix interface proceeds further to result in deterioration of fibers and thereby the composite material shows less improvement in the strength.

The metals of group IA or group IIA (except beryllium) in the periodic table or alloys thereof can be incorporated into the matrix metals by various methods, for example, by a conventional method for producing alloys. For instance, a matrix metal is molten in a vessel in air or under an inert atmosphere, and thereto are added the metals of group IA or group IIA (except beryllium) in the periodic table or alloys thereof, and the mixture is well stirred and then cooled.

The composite material of this invention can be prepared by various methods, for instance, (1) a liquid phase method (e.g. liquid metal impregnation method), (2) a powder metallurgy method (e.g. sintering, melt-bonding etc.), (3) a deposition method (e.g. metal spraying, electrodeposition, flashing, etc.), (4) a plastic working (e.g. extrusion, rolling, etc.), (5) a high-pressure casting method, and the like. The desired effect of this invention is particularly well exhibited in the case of the (1) liquid metal impregnation method and (5) high-pressure casting method, but may also be exhibited in the other methods (2) to (4).

The composite material of this invention shows extremely large improvement in mechanical strength in comparison with the product produced without using the specific additional metals, and the production can be done with conventional apparatuses and methods without the necessity of modification thereof. Accordingly, this invention is very useful for industrial production of the excellent composite materials which are useful as a material for various parts and apparatuses in various industrial fields such as aerospace, atomic power and automobile industries.

This invention is illustrated by the following Examples, but should not be construed to be limited thereto.

EXAMPLES 1-3 AND COMPARATIVE EXAMPLES 1-3

Pure zinc (purity, 99.97%) (30 kg) is taken in a graphite crucible and is molten at about 600° C. Strontium (purity, 99%) (300 g) is added to the above vessel, and the mixture is well stirred with a carbon steel bar coated with mica flour on the surface thereof to produce an Zn-Sr(1.0% by weight) alloy.

Alumina fibers ($Al_2O_3$ content: 85% by weight, $SiO_2$ content: 15% by weight, mean fiber size: 14 $\mu$m, tensile strength: 180 kg/mm$^2$, tensile modulus: 23,500 kg/mm$^2$, manufactured by Sumitomo Chemical Company, Limited, Japan) are used as an inorganic fiber. The fibers are arranged unidirectionally in a size of longitudinal length of 100 mm, horizontal length of 200 mm and a height of 6 mm. Separately, carbon fibers (mean fiber size: 8 $\mu$m, tensile strength: 370 kg/mm$^2$, tensile modulus: 23,600 kg/mm$^2$, manufactured by Sumika-Hercules, Japan) are arranged in the same size as the above alumina fibers. Alumina short fibers (RG grade, manufactured by ICI, $Al_2O_3$ content: 96–97%, $SiO_2$ content: 3–4%, mean fiber size: 3 μm, tensile strength: 100–200 kg/mm$^2$, tensile modulus: 30,000–33,000 kg/mm$^2$) are formed in a paper-like material (thickness: 1 mm) and this material is cut in a size of longitudinal length of 100 mm and horizontal length of 200 mm and are laminated in a height of 6 mm. These fibers are heated at 600° C. in a nickel-chromium furnace. Only in the case of carbon fibers, the heating is carried out while passing nitrogen gas through the furnace.

A plunger pressing mold is charged with the fibers which are previously heated, and the above Zn-Sr(1.0% by weight) alloy molten at 600° C. is poured into the cylinder and then pressed at 500 kg/cm$^2$ with a plunger, and thereby the alloy is coagurated under pressure to obtain plate-shaped composite materials.

For comparison purposes, composite materials are prepared by using pure zinc (purity, 99.97%) alone as a matrix in the same manner as described above.

Test samples for tensile strength were prepared from the above composite materials. The tensile strength was measured at room temperature by a method as defined in ASTM E8-82. The results are shown in Table 1.

TABLE 1

| No. | Inorganic fibers | Matrix | fiber content (% by volume) | Tensile strength (kg/mm$^2$) |
|---|---|---|---|---|
| 1 | Alumina fibers | Zn—Sr(1.0%) | 50 | 120 |
| 2 | Carbon fibers | Zn—Sr(1.0%) | 50 | 150 |
| 3 | Alumina short fibers | Zn—Sr(1.0%) | 15 | 60 |
| Comp. Ex. 1 | Alumina fibers | Zn | 50 | 50 |
| Comp. Ex. 2 | Carbon fibers | " | 50 | 70 |
| Comp. Ex. 3 | Alumina short fibers | " | 15 | 20 |

EXAMPLES 4–6 AND COMPARATIVE EXAMPLES 4–6

Pure lead (purity, 99.9%) (30 kg) is taken in a graphite crucible and is molten at about 450° C. Cesium (purity, 99.9%) (30 g) is added thereto, and the mixture is treated in the same manner as described in Examples 1–3 to prepare Pb-Cs(0.1% by weight) alloy. The same fibers as used in Examples 1–3 are each formed in products having the same size as in Examples 1–3, and plate-shaped composite materials are prepared under the same conditions as described in Examples 1–3 except that the heating temperature of the fibers is 400° C. (the carbon fibers are also heated in air) and the temperature of pouring of molten matrix metals is 400° C.

For comparison purposes, composite materials are prepared by using pure lead (purity, 99.4%) alone as a matrix in the same manner as described above.

Test samples for tensile strength were prepared from the above composite materials in the same manner as described in Examples 1–3. The tensile strength was measured at room temperature in the same manner as in Examples 1–3. The results are shown in Table 2.

TABLE 2

| No. | Inorganic fibers | Matrix | fiber content (% by volume) | Tensile strength (kg/mm$^2$) |
|---|---|---|---|---|
| 4 | Alumina fibers | Pb—Cs(0.1%) | 50 | 110 |
| 5 | Carbon fibers | Pb—Cs(0.1%) | 50 | 130 |
| 6 | Alumina short fibers | Pb—Cs(0.1%) | 15 | 40 |
| Comp. Ex. 4 | Alumina fibers | Pb | 50 | 40 |
| Comp. Ex. 5 | Carbon fibers | " | 50 | 60 |
| Comp. Ex. 6 | Alumina short fibers | " | 15 | 10 |

EXAMPLES 7–11

Pure zinc (purity, 99.97%) (30 kg) is taken in a graphite crucible and is molten at about 600° C. Five runs of such molten zinc are prepared.

To the molten zinc is added barium (purity, 99%), lithium (purity 99%), calcium (purity, 99%), or magnesium (purity, 99.85%), and the mixture is treated in the same manner as described in Examples 1–3 to prepare Zn-Ba(0.7% by weight) alloy, Zn-Li(0.6% by weight) alloy, Zn-Ca(0.7% by weight) alloy, Zn-Mg(0.7% by weight) alloy, and Zn-Mg (2.5% by weight) alloy.

The same alumina fiber as used in Examples 1–3 is used as the inorganic fiber. The fibers are arranged unidirectionally in the same size as in Examples 1–3. Five runs of such a product are prepared. The fibers are heated at 600° C. in a nickel-chromium furnace as in Examples 1–3.

A plunger pressing mold is charged with the fibers which are previously heated, and the above Zn alloys molten at 600° C. is poured into the cylinder and then pressed at 500 kg/cm$^2$ with a plunger, and thereby the alloy is coagurated under pressure to obtain plate-shaped composite materials as in Examples 1–3.

Test samples for tensile strength were prepared from the above composite materials. The tensile strength was measured at room temperature in the same manner as in Examples 1–3. The results are shown in Table 3.

TABLE 3

| No. | Inorganic fibers | Matrix | fiber content (% by volume) | Tensile strength (kg/mm$^2$) |
|---|---|---|---|---|
| 7 | Alumina fibers | Zn—Ba(0.7%) | 50 | 80 |
| 8 | Alumina fibers | Zn—Li(0.6%) | " | 75 |
| 9 | Alumina fibers | Zn—Ca(0.7%) | " | 95 |
| 10 | Alumina fibers | Zn—Mg(0.7%) | " | 110 |
| 11 | Alumina fibers | Zn—Mg(2.5%) | " | 70 |

What is claimed is:

1. A fiber-reinforced metallic composite material, which comprises as a matrix a metal alloy having a lower melting point than magnesium and being chemically inactive and as a reinforcement inorganic fibers of 15 to 70% by volume, said metal alloy composing the matrix containing 0.01 to 10% by weight of at least one metal selected from the group consisting of metals of group IA and metals of group IIA (except beryllium) in the periodic table.

2. The fiber-reinforced metallic composite material according to claim 1, wherein the metal alloy composing the matrix is incorporated with 0.1 to 5% by weight of at least one metal selected from the group consisting of metals of group IA and metals of group IIA (except beryllium) in the periodic table.

3. The fiber-reinforced metallic composite material according to claim 1, wherein the metal alloy having a lower melting point than magnesium and being chemically inactive has a base metal selected from the group consisting of zinc, cadmium, indium, tin, thallium, lead, bismuth and polonium.

4. The fiber-reinforced metallic composite material according to claim 1, wherein the inorganic fiber is alumina fiber having an alumina content of 72 to 100% by weight and a silica content of 0 to 28% by weight and exhibiting substantially no reflection by X-ray diffraction due to the $\alpha$-$Al_2O_3$ structure.

5. The fiber-reinforced metallic composite material according to claim 4, wherein the alumina fiber is incorporated with a refractory oxide compound of a metal selected from the group consisting of lithium, beryllium, boron, sodium, magnesium, silicon, phosphorus, potassium, calcium, titanium, chromium, manganese, yttrium, zirconium, lanthanum, tungsten, and barium.

* * * * *